United States Patent [19]

Ganser et al.

[11] Patent Number: 4,594,531

[45] Date of Patent: Jun. 10, 1986

[54] CIRCUIT ARRANGEMENT FOR OPERATING HIGH-PRESSURE GAS DISCHARGE LAMPS

[75] Inventors: Hans G. Ganser, Stolberg; Ralf Schäfer, Aachen; Hans P. Stormberg, Stolberg, all of Fed. Rep. of Germany

[73] Assignee: U.S. Philips Corporation, New York, N.Y.

[21] Appl. No.: 633,756

[22] Filed: Jul. 23, 1984

[30] Foreign Application Priority Data

Jul. 27, 1983 [DE] Fed. Rep. of Germany ..... 3327030

[51] Int. Cl.[4] ..... H05B 41/24; H05B 41/14

[52] U.S. Cl. ..... 315/307; 315/224; 315/287; 315/DIG. 7

[58] Field of Search ..... 315/307, 308, 287, 224, 315/DIG. 7

[56] References Cited

U.S. PATENT DOCUMENTS

| | | | |
|---|---|---|---|
| 3,265,930 | 8/1966 | Powell, Jr. | 315/224 X |
| 3,486,070 | 12/1969 | Engel | 315/224 X |
| 3,657,598 | 4/1972 | Nomura et al. | 315/287 X |
| 3,913,002 | 10/1975 | Steigerwald et al. | 315/224 X |
| 4,051,411 | 9/1977 | Knoble et al. | 315/DIG. 7 X |
| 4,132,925 | 1/1979 | Schmutzer et al. | 315/224 X |
| 4,412,154 | 10/1983 | Klein | 315/287 X |
| 4,412,156 | 10/1983 | Ota | 315/287 X |
| 4,456,855 | 6/1984 | Sairanen | 315/287 X |

*Primary Examiner*—David K. Moore
*Assistant Examiner*—Vincent DeLuca
*Attorney, Agent, or Firm*—Robert T. Mayer; Bernard Franzblau

[57] ABSTRACT

A circuit arrangement for operating high-pressure gas discharge lamps (6) with a current of higher frequency comprising a switching mains section including a switching transistor (4) and a control device (9), in which an upper and a lower reference current level (O,U) are produced. The switching transistor is switched to the non-conducting state when the lamp current exceeds the upper level (O) and is switched to the conducting state when this current falls below the lower level (U). The interval between the reference current levels (O,U) is more than 10% of the average lamp current and a further intermediate reference current level (M) is provided at which the switching transistor is switched each time at a predetermined number of passages of the lamp current through the intermediate reference current level.

13 Claims, 5 Drawing Figures

Figure 4:
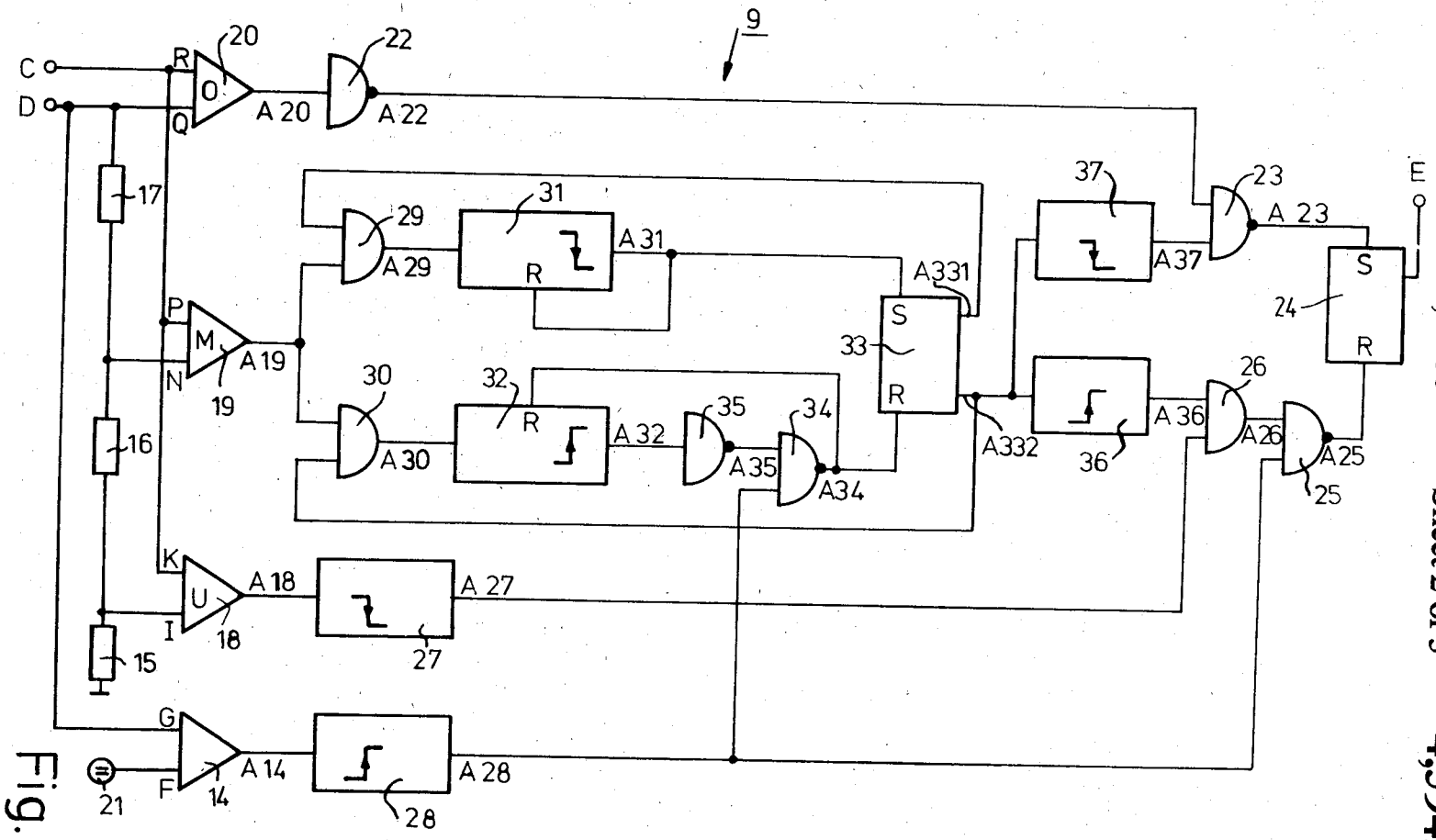

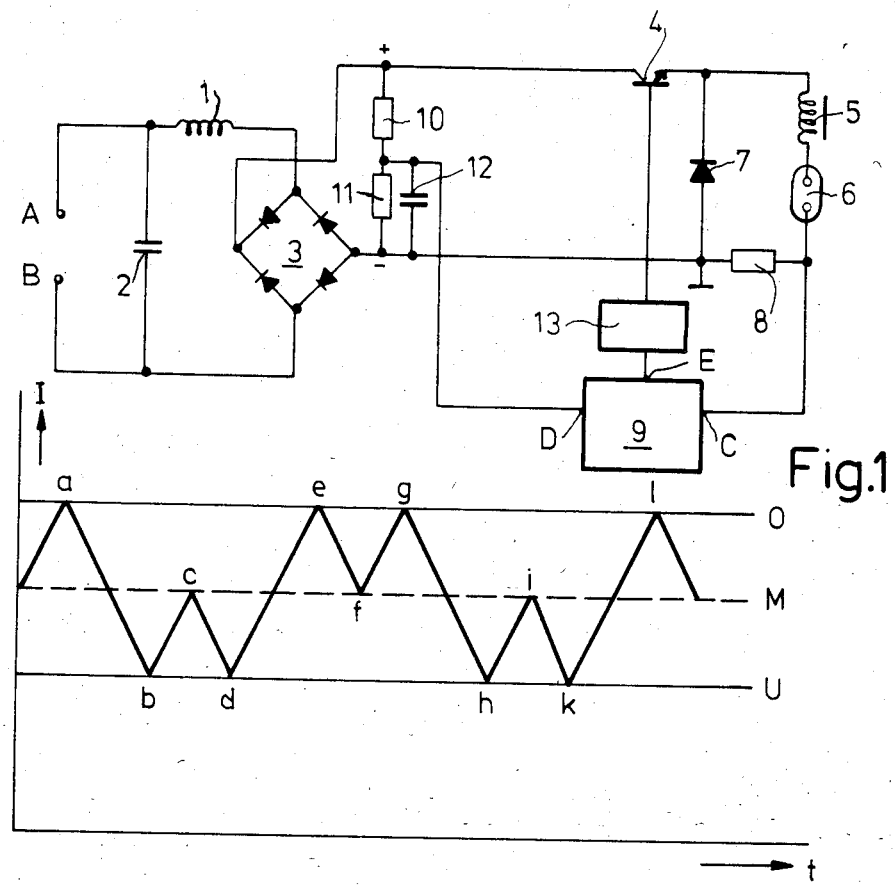
Fig.1
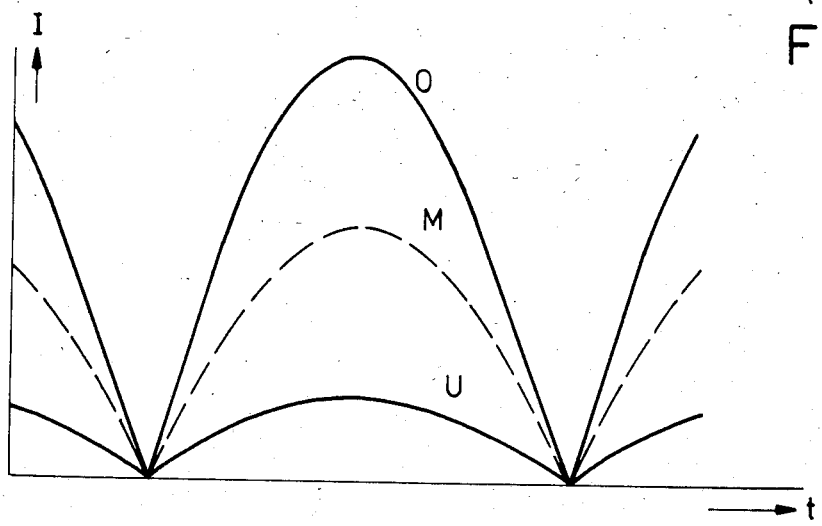
Fig.2
Fig.3

CIRCUIT ARRANGEMENT FOR OPERATING HIGH-PRESSURE GAS DISCHARGE LAMPS

The invention relates to a circuit arrangement for operating high-pressure gas discharge lamps with a current of higher frequency comprising a full-wave rectifier connected to an alternating voltage mains and supplying an output direct voltage to a switching mains section comprising at least one switching transistor, a choke coil, a fly-wheel diode and the discharge lamp. The high-frequency switching speed of the switching transistor is controlled via a driver stage by a control device which compares the instantaneous lamp current sensed by a current sensor with an upper and a lower reference current level (0,U), the switching transistor being switched to the non-conducting state when the lamp current exceeds the upper level (0), and being switched to the conducting state when this current fails below the lower level (U).

Such a circuit arrangement produces a direct current pulsating in the rhythm of the mains frequency, onto which is modulated a high-frequency component dependent upon the switching speed of the switching transistor.

U.S. Pat. No. 4,082,856 discloses a circuit arrangement of this kind comprising a switching mains section in the form of a forward converter and a control device having a comparator with hysteresis, which compares the instantaneous lamp current with a given reference current and which, when deviations from this reference current determined by hysteresis are reached, switches the switching transistor to the conducting state and to the non-conducting state, respectively. As a result, the lamp is fed with a pulsating direct current, onto which a high-frequency amplitude is modulated.

In such circuit arrangements, because of miniaturization endeavors are made to limit the dimension of the choke coil to a minimum. The inductance of the choke coil depends, however, upon the height of the high-frequency modulation, i.e. upon the relative distance of the upper and the lower reference current level. This appears from the formula $$T = \left(\frac{1}{I_o} + \frac{1}{V/R - I_u}\right) \cdot \frac{L}{R} \cdot (I_o - I_u),$$

in which T is the period duration of the sawtooth-shaped high-frequency modulation, $I_o$ is the upper and $I_u$ is the lower reference current level, L is the inductance of the choke coil, R is the lamp resistance and V is the instantaneous value of the rectified mains voltage. For a switching frequency of the switching transistor of 40 kHz, it can be calculated therefrom, for example, that the inductance of the choke coil in the case of a modulation height of 10% of the average lamp current is about ten times as large as in the case of a modulation height of 150% of the average lamp current. An increase of the high-frequency modulation consequently leads to considerably smaller choke coils and hence to a reduction of the cost and the size of the ballast unit of the lamp.

On the other hand, however, it is known that even a very small high-frequency modulation of less than 10% in high-pressure gas discharge lamps, for example in metal halide discharge lamps or in mercury vapour high-pressure lamps may lead to acoustic arc instabilities. Although it is known from U.S. Pat. No. 4,082,856 that the occurrence of acoustic arc instabilities can be avoided by the frequency of the lamp current, it has been found in practice that this is substantially not effective for miniaturized high-pressure gas discharge lamps. If the high-frequency modulation were kept so low that no acoustic arc instabilities could occur in the lamp, not only would the apparatus suffer the disadvantage of a comparatively large choke coil, but also the switching transistor, the driver stage and the control device would have to be screened satisfactorily because they would be sensitive to interference pulses due to the small height of the high-frequency modulation.

Therefore, the invention has for an object to provide a circuit arrangement for operating high-pressure gas discharge lamps with current of higher frequency and operative with high-frequency modulations of up to 200% of the average lamp current, whereby very small choke coils can be used and without acoustic arc instabilities occurring in the lamp.

According to the invention, in a circuit arrangement of the kind mentioned in the opening paragraph, this object is achieved in that there is adjusted in the interval between the reference current levels (O,U), which is more than 10% of the average lamp current, a further intermediate reference current level (M) is adjusted, at which the switching transistor is switched each time after a number of passages of the lamp current through the intermediate reference current level (M), the number being adjusted in the control device.

It is a surprise to find that in this circuit arrangement the height of the reference modulation can be up to 200% of the average lamp current without acoustic arc instabilities occurring when the switching transistor is switched upon the passage of the lamp current through the intermediate reference current level. Upon the passage through the intermediate reference current level, the switching transistor need not necessarily be switched, for example, every second or third passage of the lamp current, but the transistor may be switched with a different periodicity or aperiodically.

In order to compare the instantaneous lamp current with the three reference current levels, preferably three hysteresis-free comparators are provided, at each of the outputs of which a high (H) signal occurs when the instantaneous lamp current exceeds the corresponding reference current level, and a low (L) signal occurs when the lamp current falls below the reference current level. Consequently, three reference current levels are produced by the hysteresis-free comparators.

In a preferred embodiment of the circuit arrangement according to the invention, the set input of a first bistable trigger circuit constituting the output of the control device is connected to the output of the O-comparator via an inverter and a first NAND gate. The reset input Q of this trigger circuit is connected via an AND gate and a second NAND gate as well as via a monostable trigger circuit triggering at negative edges to the U-comparator. The second inputs of the NAND gate and of the first NAND gate are simultaneously acted upon by the output signals of a counting circuit connected to the M-comparator in a manner such that the output of the counting circuit connected to the AND gate produces a H/L/H pulse each time at a number of passages effected from the upper side through the intermediate reference current level, the number being adjusted in the counting circuit, while the output of the counting circuit connected to the NAND gate produces a H/L/H pulse each time at a number of passages from the lower side through the intermediate reference current level, the number being adjusted in the counting circuit.

The connection of the O-comparator via the inverter and the first NAND gate to the first bistable trigger circuit has the advantage that also in the case of interferences in other parts of the circuit arrangement, for example caused by interference pulses or defective structural elements, the switching transistor is nevertheless always switched to the non-conducting state as soon as the lamp current reaches the upper reference current level 0. Consequently, damage to the switching transistor by excessively high currents becomes impossible and a possible explosion of the lamp due to excessively high powers is also prevented.

Efficaciously, the counting circuit includes a first monostable trigger circuit triggered at positive edges and a second monostable trigger circuit triggered at negative edges, whose inputs are connected to the output of a second bistable trigger circuit, whose set input is acted upon via a first counter triggered at negative edges and an AND gate by the output signal of the M-comparator, while at the same time its reset input is also connected via a third NAND gate, an inverter, a second counter triggered at the positive edges and a further AND gate to the output of the M-comparator. Moreover the second inputs of each of the NAND gates are connected to the outputs of the second bistable trigger circuit. The first counter is reset by the signal present at the set input of the second bistable trigger circuit and the second counter is reset by the signal present at the reset input of this second trigger circuit. This construction of the counting circuit has the advantage that the output signals of the second bistable trigger circuit as well as the output signals of the counters are directly utilized to reset the circuit arrangement and consequently no delay times due to further structural elements occur so that the switching operation at the intermediate reference current level (M) takes place as free from delay as possible.

If, according to an advantageous further embodiment of the circuit arrangement in accordance with the invention, the second inputs of each of the second and the third NAND gates are connected via a further monostable trigger circuit triggering at positive edges to the output of a hysteresis-free comparator detecting the zero passages of the mains voltage, the advantage is obtained that the control device is reset to a defined starting condition at each zero passage of the mains voltage.

The switching frequency of the switching transistor is usually situated between 10 and 100 kHz, preferably between 20 and 50 kHz.

Figure 5:
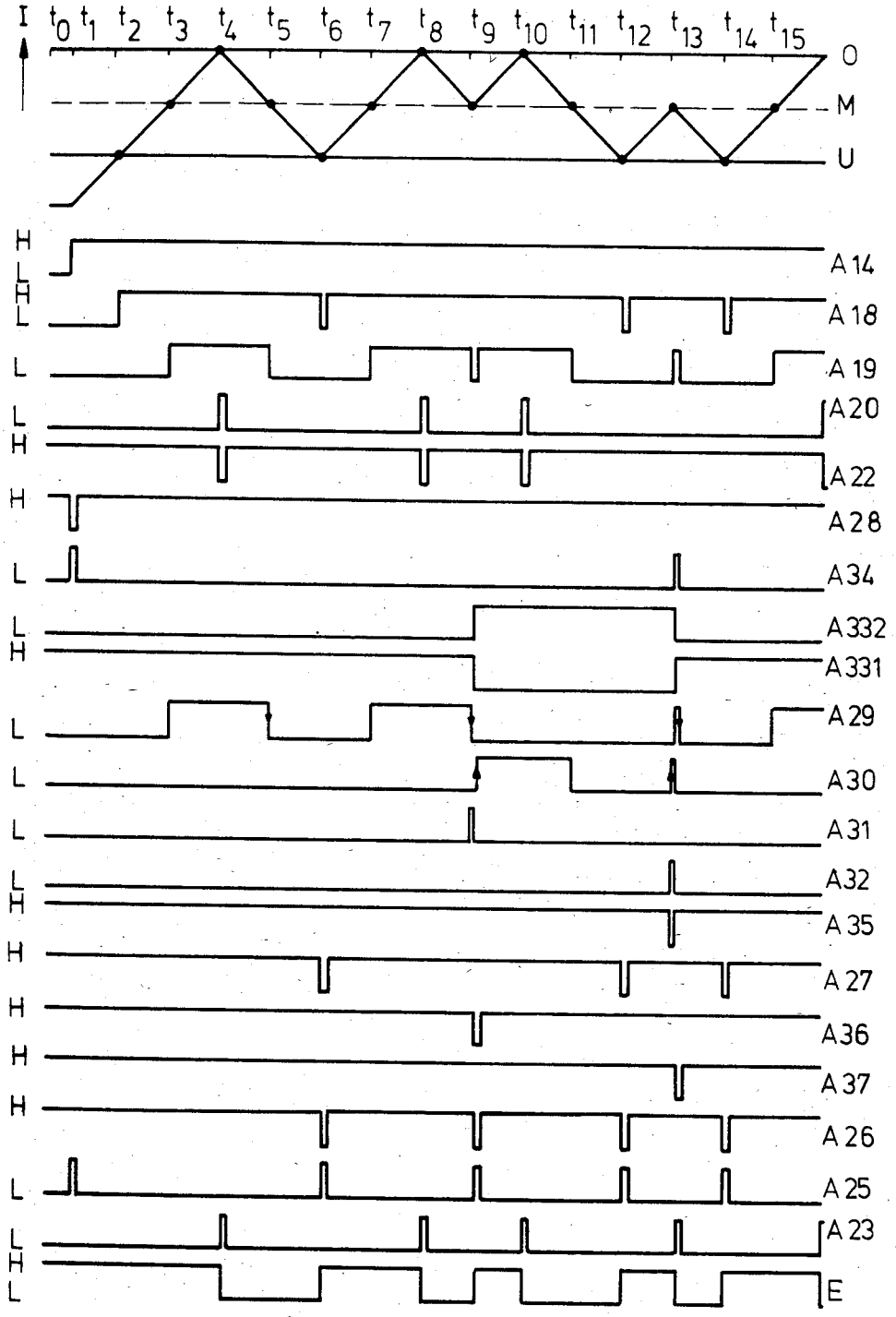

In order that the invention may be readily carried out, it will now be described more fully, by way of example, with reference to the accompanying drawing, in which:

FIG. 1 shows a circuit arrangement for operating a high-pressure gas discharge lamp comprising a forward converter controlled by a control device, FIG. 2 shows the lamp current as a function of time with associated reference current levels, FIG. 3 shows the variation of the reference current levels as a function of time during a half period of the mains alternating voltage, FIG. 4 shows the circuit diagram of the control device used in the circuit arrangement shown in FIG. 1, and FIG. 5 shows the diagrams of pulse trains occurring in the control device shown in FIG. 4.

In FIG. 1, A and B designate input terminals for connection to an alternating voltage mains of, for example, 220 V, 50 Hz. A full-wave rectifier 3 comprising four diodes is connected to these input terminals A and B via a high-frequency filter comprising a filtering coil 1 and a filtering capacitor 2. A forward converter comprising at least one switching transistor 4, a choke coil 5, a high-pressure gas discharge lamp 6 and a fly-wheel diode 7 is connected to the output of the full-wave rectifier 3. Further, the lamp circuit includes a measuring resistor 8 which serves as a current sensor and across which a voltage proportional to the instantaneous lamp current is derived. This voltage is fed to the input C of a control device 9. The lamp current is controlled by a reference current signal occurring at input D of control device 9 in a manner to be described more fully hereinafter.

In this case, the current drawn from the alternating voltage mains should have a variation as sinusoidal as possible. In the present embodiment, it proved to be sufficient to feed the rectified mains voltage stepped down by a voltage divider 10, 11 as a reference signal to the input D of the control device 9, a capacitor 12 serving to filter high-frequency voltage components. The switching transistor 4 is switched to the conducting state and to the non-conducting state by the signal occurring at the output E of the control device 9 via a driver stage 13, as a result of which the lamp current is formed as follows.

In the control device 9, in dependence upon the reference current signal at D, an upper and a lower reference current level 0 and U, respectively, as well as an intermediate reference current level M can be adjusted for the lamp current I (FIG. 2). The control device 9 then operates so that, when the upper reference current level 0 is reached, the switching transistor 4 is switched to the nonconducting state (points a, e, g, 1 in FIG. 2) so that the supply of the lamp 6 from the alternating voltage mains is interrupted and the lamp current decreases with a time constant determined by the inductance of the choke coil 5. When the lower reference current level U is reached (points b, d, h, k in FIG. 2), the switching transistor 4 is again switched to the conducting state and the lamp current increases again. According to the invention, at an adjusted number of passages of the lamp current through the intermediate reference current level M (points c, f, i in FIG. 2) the switching transistor 4 is switched either to the nonconducting state if it was conducting before (points c,i), that is to say if the intermediate reference current level M is passed from the lower side, or to the conducting state if it was non-conducting before (point f), that is to say if the intermediate reference current level M is passed from the upper side. For a number equal to two, the variation indicated by full lines in FIG. 2 is obtained for the lamp current. The switching frequency of the switching transistor 4 is then of the order of about 10 to 100 kHz, dependent upon the size of the choke coil 5 and the lamp 6 used. Consequently, the average lamp current follows the intermediate reference current level M, which again, as shown in FIG. 3, has a sinusoidal variation in accordance with the reference current signal at the input D of the control device 9, as a result of which the mains distortion is kept small. It has now been found that with the lamp current waveform shown in FIG. 2 the high-frequency modulation passing between the upper and the lower reference current level 0 and U can be up to 200% without acoustic arc instabilities being observed in the lamp 6. If, on the other hand, the switching transistor 4 is not switched at the intermediate level M, only a small high-frequency modulation is permissible, which has the disadvantages set out more fully hereinbefore.

A circuit arrangement for the control device 9 will now be described more fully with reference to FIGS. 4 and 5. The reference current signal occurring at the input D of the control device 9 is fed directly to the signal input G of a hysteresis-free comparator 14 and via a voltage divider comprising resistors 15, 16 and 17 to the reference inputs I, N, Q of three hysteresis-free comparators 18, 19 and 20. At the same time the lamp current signal is supplied from the input C of the control device 9 to their signal inputs K,P,R. A constant direct voltage is fed to the reference input F of the comparator 14 by a direct voltage generator 21 and the purpose of this voltage will be explained more fully hereinafter.

The operation of the comparators is such that a high (H) signal occurs at their outputs A14, A18, A19, A20 each time that the voltage at the signal input G, K, P or R exceeds the voltage at the reference input F, I, N or Q, whereas in the opposite case a low (L) signal occurs each time at the outputs A14 to A20. The reference current levels 0, M and U shown in FIG. 2 are consequently adjusted by the choice of the voltage divider 10,11 of FIG. 1 and the voltage divider 15,16,17 of FIG. 4.

An inverter 22 is connected to the output A20 of the O-comparator 20 and a first NAND gate 23 is connected to the output A22 of this comparator. The output A23 of this first NAND gate is connected to the set input S of a first bistable trigger stage 24, which constitutes the output E of the control device 9. The reset input R of the bistable trigger circuit 24 is connected to the U-comparator 18 via a second NAND gate 25, an AND gate 26 and a monostable trigger stage 27 triggered at negative edges. A monostable trigger circuit 28 triggered at positive edges is connected to the comparator 14, the output A28 of the circuit 28 being connected to the second input of the NAND gate 25. The M-comparator 19 is followed by two AND gates 29 and 30, whose outputs A29 and A30, respectively, are each connected to a counter 31 and 32. The output A31 of the counter 31 is connected to its reset input R and to the set input S of a second bistable trigger circuit 33, whose reset input R is connected via a third NAND gate 34 and an inverter 35 to the output A32 of the counter 32. At the same time, the reset input R of the counter 32 is connected to the output A34 of the NAND gate 34. The output A331 of the second bistable trigger circuit 33 is connected to the second input of the AND gate 29 and the output A332 of this bistable trigger circuit 33 is connected to the second input of the AND gate 30. Furthermore, two further monostable trigger circuits 36 and 37 are connected to the output A332 of the bistable trigger circuit 33. The outputs A36 and A37 of the circuits are connected to the second inputs of the AND gate 26 and of the NAND gate 23, respectively. The output A26 of the AND gate 26 is connected to the first input of the NAND gate 25, whose output A25 is again connected to the reset input R of the first bistable trigger circuit 24.

The further operation of the control device 9 shown in FIG. 4 will now be explained with reference to the pulse train diagrams of FIG. 5. It is assumed that at the instant $t_o$ the mains alternating voltage is applied and that at $t_o$ the mains zero passage takes place, respectively. When the mains alternating voltage reaches an instantaneous value of about 20 V, the reference signal at the input G of the comparator 14 exceeds the direct voltage fed to the input F and a H signal is obtained at the output A14 (instant $t_1$). As a result, a H/L/H pulse is produced at the output A28 of the monostable trigger circuit 28 which is triggered at the positive edges an input signal from A14. Due to this pulse, and L/H/L pulse is produced at each of the outputs A34 and A25 of the NAND gates 34 and 25 and these pulses are fed to the reset inputs R of the bistable trigger circuits 33 and 24, respectively so that the output A332 of the bistable trigger stage 33 is set to L signal, its output A331 is set to H signal and the output E of the bistable trigger stage 24 is also set to H signal. Due to the H signal at the output E, the switching transistor 4 of FIG. 1 is then switched via the driver stage 13 to the conducting state so that the current through the lamp 6 begins to rise. When the lower reference current level U is exceeded (instant $t_2$), a H signal is obtained at the output A18 of the U-comparator 18 and, when the intermediate reference current level M is reached (instant $t_3$), an H signal is obtained at the output A19 of the M-comparator 19. In this condition, an H signal is present at both inputs of the AND gate 29 so that an H signal is also present at the output A29. At the instant $t_4$, the lamp current exceeds the upper reference current level 0, as a result of which an H signal occurs at the output A20 of the O-comparator 20 and an L signal occurs at the output A22 of the inverter 22. Thus, and L signals are present at the inputs of the NAND gate 23 so that an H signal is obtained at its output A23, which is switched to the setting input of the bistable trigger circuit 24.

Due to this L/H transition, the output E of the bistable trigger circuit 24 is set to L signal and consequently the switching transistor 4 is switched to the nonconducting state via the driver stage 13. As a result, the connection between the lamp 6 and the alternating voltage mains is interrupted and the lamp current again falls below the upper reference current level 0, as a result of which the output A20 of the O-comparator 20 is switched to L signal, the output A22 of the inverter 22 is switched to H signal and the output A23 of the NAND gate 23 is switched to L signal, which, however, does not lead to any variation of the output signal at E so that the lamp current decreases further and, when the intermediate reference current level M is reached (instant $t_5$), the output A19 of the M-comparator 19 is switched to L signal. Since L and H signals are present at the inputs of the AND gate 29, an H/L transition occurs for the first time at its output A29, which transition is counted by the counter 31 triggered at the negative edges. Since the latter is connected in the present case as a binary counter, its output A31 still remains at the L signal. When the signal falls below the reference current level U (instant $t_6$), the output A18 of the U-comparator 18 is switched to L signal, as a result of which the monostable trigger circuit 27 triggering at negative edges supplies at its output A27 an H/L/H pulse so that an H/L/H pulse also occurs at the output A26 of the AND gate 26 and consequently an L/H/L pulse occurs at the output A25 of the NAND gate 25. This latter pulse switches with its H/L transition the output E of the bistable trigger circuit 24 to H signal via the reset input R. Thus, the switching transistor 4 becomes conducting and the lamp current again exceeds the reference current level U so that the U-comparator 18 is switched to H signal. When the intermediate reference current level M is reached (instant $t_7$), the M-comparator 19 passes to an H signal so that an H signal occurs at both inputs of the AND gate 29 and consequently its output A29 is also switched to an H signal. When the upper reference current level 0 is reached at the instant $t_8$, the process described for the instant $t_4$ is repeated and the lamp current falls until the intermediate reference current level M is reached (instant $t_9$) so that the output A19 of the M-comparator 19 is switched to an L signal. As a result, an L signal and an H signal occur at the input of the AND gate 29 so that its output A29 has a second H/L transition, which is counted by the binary counter 31. Thus, the output A31 of the counter 31 supplies an H signal, as a result of which it is reset automatically via the connection to its reset input, that is to say the output A31 passes again to an L signal and the binary counting process starts again.

The L/H/L pulse from the counter output A31 is fed to the set input of the bistable trigger circuit 33 so that its output A332 is switched to an H signal and its output A331 is switched to an L signal. As a result H signals occur at both inputs of the AND gate 30 and consequently an H signal occurs for the first time at its output A30, the L/H transition being counted by the counter 32 triggering at positive edges. However, an L signal remains at its output A32 because the counter 32 is also connected as a binary counter. Due to the L/H transition at the output A332 of the bistable trigger circuit 33, an H/L/H pulse occurs at the output A36 of the monostable trigger circuit 36 triggering at positive edges so that an L/H/L pulse also occurs at the output A26 of the AND gate 26 and hence an L/H/L pulse occurs at the output A25 of the NAND gate 25. As a result the output E of the bistable trigger circuit 24 is switched to an H signal. Thus, the switching transistor 4 is turned on and the lamp current rises again, as a result of which the output A19 of the M-comparator 19 passes to an H signal. When the upper reference current 0 is exceeded at the instant $t_{10}$, the process described for the instant $t_4$ is repeated and the lamp current falls. When the current falls below the intermediate reference current level M (instant $t_{11}$), the output A19 of the M-comparator 19 passes to an L signal so that L and H signals are present at the inputs of the AND gate 30 and hence the output A30 thereof is switched to an L signal. At the instant $t_{12}$, the process described for the instant $t_6$ is repeated and the lamp current rises until the intermediate reference current level M is reached at the instant $t_{13}$, as a result of which the output A19 of the M comparator 19 is switched to an H signal. Thus, an H signal is present at both inputs of the AND gate 30 and its output A30 passes for the second time to an H signal. This second L/H transition is counted by the binary counter 32 and its output A32 also passes to an H signal occurs, as a result of which an L signal at the output A35 of the inverter 35 and hence an H signal occurs at the output A34 of the NAND gate 34. Due to this L/H transition, the counter 32 is reset via its reset input, that is to say that its output A32 passes to an L signal. Further, the output A332 of the bistable trigger circuit 33 is switched to L signal and its output A331 is switched to H signal by the L/H/L pulse at the output A34 of the NAND gate 34 so that again L and H signals are present at the inputs of the AND gate 30 and hence its output A30 passes to an L signal. Moreover, due to the H/L transition at the output A332 of the bistable trigger circuit 33, an H/L/H pulse is produced at the output A37 of the monostable trigger circuit 37 triggering at negative edges, as a result of which an L/H/L pulse occurs at the output A23 of the NAND gate 23. This pulse sets the output E of the bistable trigger circuit 24 to an L signal. As a result, the switching transistor 4 is switched to the non-conducting state via the driver stage 13 and the lamp current falls so that the output A19 of the M-comparator 19 again passes to an L signal. As a result, L and H signals are again present at the inputs of the AND gate 29 and an L signal occurs at its output A29. From the instant at which the lower reference current level U is reached ($t_{14}$), the process carried out between the instants $t_6$ and $t_{14}$ is then repeated periodically until the mains voltage returns to the vicinity of the mains zero passage, as a result of which the lamp current falls automatically below the lower reference current level U.

In the next alternating-current half period, the whole process starts again by resetting the circuit arrangement via the comparator 14. This has the advantage that a failure in the operation of the counting circuit due to interference pulses occurring incidentally is possible only during an a.c. half period. Moreover, due to the resetting at the beginning of each a.c. half period it is guaranteed that after each zero passage of the current the circuit arrangement operates again at its preliminarily chosen reference current levels.

In a practical embodiment for operating a 45 W-metal halide high-pressure discharge lamp with a lamp operating voltage of about 50 V at a mains input voltage of 220 V, 50 Hz, the following circuit elements were used:

| | |
|---|---|
| comparators 14, 18, 19, 20 | LM 339 of Valvo |
| monostable trigger circuits 27, 28, 36, 37 | HEF 4528 of Valvo |
| bistable trigger circuits 24, 33 | HEF 4027 of Valvo |
| AND gates 26, 29, 30 | HEF 4081 of Valvo |
| NAND gates 23, 25, 34 | HEF 4011 of Valvo |
| Inverters 22, 35 | HEF 4011 of Valvo |
| Resistor 8 | ~1 Ω |
| Resistor 10 | 150k Ω |
| Resistor 11 | 1k Ω |
| Resistor 15 | 5k Ω |
| Resistor 16 | 5k Ω |
| Resistor 17 | 5k Ω |
| Capacitor 12 | 100 nF |
| Choke coil 5 | 1 mH. |

The principle according to the invention of a control circuit having three reference current levels is not limited to the forward converter arrangement described, but may also be used in other switching mains sections, such as, for example, a fly-back converter.

What is claimed is:

1. A circuit arrangement for operating a high-pressure gas discharge lamp with a current of high frequency comprising: a full-wave rectifier for connection to an alternating voltage mains to supply an output direct voltage to a switching mains section comprising at least a switching transistor, a choke coil, a fly-wheel diode and the discharge lamp, the switching transistor being controlled at a high frequency via a driver stage by means of a control device which compares the instantaneous lamp current sensed by a current sensor with an upper and a lower reference current level (O,U), wherein the interval between the upper and lower reference current levels is more than 10% of the average lamp current, the switching transistor being switched by the control device to the non-conducting stage when the lamp current exceeds the upper level and being switched to the conducting state when said current falls below the lower level, and wherein the switching transistor is switched each time by the control device at an intermediate reference current level (M) between the upper and lower reference current levels after a number of passages of the lamp current through the intermediate reference current level (M), the number of passages being determined by the control device.

2. A circuit arrangement as claimed in claim 1, characterized in that the instantaneous lamp current is compared with the three reference current levels (O,M,U) by three hysteresis-free comparators having outputs at which a high (H) signal occurs each time that the instantaneous lamp current exceeds the corresponding reference current level (O,M,U), and a low (L) signal occurs each time that the lamp current falls below the corresponding reference current level.

3. A circuit arrangement as claimed in claim 2 wherein the control device comprises: a first bistable trigger circuit having a set input, a reset input, and an output comprising the output of the control device, means connecting the set input of the first bistable trigger circuit to the output of the O-comparator via an inverter and a first NAND gate, means connecting the reset input of said trigger circuit via an AND gate, a second NAND gate and a monostable trigger circuit triggering at negative edges to the U-comparator, second inputs of the AND gate and of the first NAND gate being simultaneously acted upon by output signals of a counting circuit connected to the M-comparator in a manner such that an output of the counting circuit connected to the AND gate produces a pulse each time at a number of passages effected from the upper side of the lamp current through the intermediate reference current level (M), the number being adjusted to the counting circuit, and wherein an output of the counting circuit connected to the NAND gate produces a pulse each time at a number of passages through the intermediate reference current level (M) effected from the lower side, the number being adjusted in the counting circuit.

4. A circuit arrangement as claimed in claim 3, wherein the counting circuit comprises: a first monostable trigger circuit triggered at positive edges and a second monostable trigger circuit triggered at negative edges, means connecting inputs of the first and second monostable trigger circuits to an output of a second bistable trigger circuit having a set input acted upon via a first counter triggered at negative edges and an AND gate by the output signal of the M-comparator, means connecting a reset input of the second bistable trigger circuit via a third NAND gate, an inverter, a second counter triggered at positive edges and a further AND gate to the output of the M-comparator, and means connecting second inputs of each of the AND gates to the outputs of the second bistable trigger circuit, the first counter being reset by the signal present at the set input of the second bistable trigger circuit and the second counter being reset by the signal present at the reset input of the second bistable trigger circuit.

5. A circuit arrangement as claimed in claim 4, wherein second inputs of each of the second and third NAND gates are connected via a further monostable trigger circuit triggered at positive edges to an output of a hysteresis-free comparator which detects the zero passages of the mains voltage.

6. Apparatus for operating a high pressure discharge lamp comprising: a pair of input terminals for connection to a low frequency source of DC pulsating voltage, means for connecting a switching transistor and a reactance element in series with the discharge lamp across the input terminals, a diode couplable to the lamp to provide a path for lamp current to flow when the switching transistor is cut-off, and a control device coupled to a control electrode of the switching transistor for operating the switching transistor at a high frequency switching rate, said control device deriving upper and lower reference current levels and an intermediate reference current level between the upper and lower reference current levels, said control device including hysteresis-free comparison means for comparing said reference current levels with the lamp current so as to derive a switching control signal that triggers the switching transistor into cut-off and conduction at lamp current levels equal to the upper and lower reference current levels, respectively, and wherein the control device derives a switching control signal that, after a predetermined number of passages of the lamp current through the intermediate reference current level, triggers a change of state of the switching transistor each time the lamp current subsequently passes through the intermediate reference current level.

7. An apparatus as claimed in claim 6 wherein the reactance element comprises an inductor and said reference current levels are derived from a voltage divider coupled to said input terminals.

8. An apparatus as claimed in claim 6 wherein the control device further comprises means coupled to said input terminals for resetting the control device to a predetermined starting condition at approximately each zero passage of the source of pulsating voltage.

9. An apparatus as claimed in claim 6 wherein the comparison means of the control device comprises upper, lower and intermediate level hysteresis-free comparators, the control device further comprising a first bistable device having set and reset inputs controlled by the upper and lower comparators, respectively, and an output at which the switching control signal is derived, and a counting circuit controlled by an output of the intermediate comparator and having an output coupled to the set and reset inputs of the first bistable device for triggering the bistable device into a first change of state when the lamp current reaches the intermediate reference current level while increasing in amplitude from the lower reference level and for triggering the bistable device into a second opposite change of state when the lamp current reaches the intermediate reference current level while decreasing in amplitude from the upper reference level.

10. An apparatus as claimed in claim 9 further comprising a further comparator controlled by the voltage at said input terminals and having an output coupled to the reset input of the first bistable device via a gating circuit so as to reset the bistable device at approximately each zero passage of the voltage at the input terminals.

11. An apparatus as claimed in claim 9 wherein the counting circuit comprises first and second binary counters controlled by an output of the intermediate comparator and a second bistable device having set and reset inputs coupled to respective outputs of the first and second counters and an output coupled to the set and reset inputs of the first bistable device via respective gating circuits, and a further comparator controlled by the voltage at said input terminals and having an output coupled to the reset inputs of the first and second bistable devices via respective gating circuits so as to reset the bistable devices at approximately each zero passage of the voltage at the input terminals.

12. An apparatus as claimed in claim 6 wherein the comparison means of the control device comprises upper, lower and intermediate level hysteresis-free comparators, the control device further comprising a first bistable device having a set input coupled to an output of the upper comparator via an inverter and a first NAND gate connected in cascade, said first bistable device having a reset input coupled to an output of the lower comparator via a monostable trigger circuit, an AND gate and a second NAND gate connected in cascade, and a counting circuit coupled to an output of the intermediate comparator and having an output coupled to second inputs of the AND gate and the first NAND gate whereby pulses are supplied either to the set or reset input of the first bistable device when the lamp current passes through the intermediate reference current level at given times and determined by whether the lamp current is increasing or decreasing as it passes through said intermediate reference current level.

13. An apparatus as claimed in claim 6 wherein the control device includes a counting circuit responsive to the comparison means for determining said predetermined number of passages of the lamp current through the intermediate reference current level so as to inhibit acoustic resonance in the lamp.

* * * * *